United States Patent [19]

Krall et al.

[11] 4,096,907

[45] Jun. 27, 1978

[54] STRAND WITHDRAWAL ASSEMBLY FOR CONTINUOUS CASTING PLANTS

[75] Inventors: Heribert A. Krall, Wurzburg; Helmut Maag, Waldbüttelbrunn, both of Germany

[73] Assignee: Technica-Guss GmbH, Wurzburg, Germany

[21] Appl. No.: 818,688

[22] Filed: Jul. 25, 1977

[30] Foreign Application Priority Data

Oct. 28, 1976 Germany ..... 2649015

[51] Int. Cl.[2] ..... B22D 11/12; B65H 17/20

[52] U.S. Cl. ..... 164/448; 226/109; 226/185; 226/186; 226/190

[58] Field of Search ..... 164/442, 448; 193/35 R, 193/35 B, 37; 198/780, 789, 790, 791; 308/20; 226/109, 185, 186, 190; 72/226

[56] References Cited

U.S. PATENT DOCUMENTS 838,772 12/1906 Crane ..... 226/190 X

FOREIGN PATENT DOCUMENTS 868,197 4/1971 Canada ..... 164/448

*Primary Examiner*—Francis S. Husar
*Assistant Examiner*—John S. Brown
*Attorney, Agent, or Firm*—Jones, Tullar & Cooper

[57] ABSTRACT

A strand withdrawal assembly for use in clamping strands being withdrawn from a casting mould of a continuous casting plant is disclosed. At least two strands are withdrawn and are clamped between a lower, driven roll and a pair of upper rolls. The upper rolls are rotatably mounted on an eccentric shaft which is itself rotatably supported at either end and is capable of being raised or lowered by suitable hydraulic cylinders. The eccentric shaft accommodates minor variations in thickness of the clamped strands and allows for the application of equal pressure to the strands even though they are of unequal and varying thicknesses.

3 Claims, 2 Drawing Figures

STRAND WITHDRAWAL ASSEMBLY FOR CONTINUOUS CASTING PLANTS

FIELD OF THE INVENTION

The present invention is directed generally to a clamping or pinch roll assembly in a strand withdrawal assembly for a continous casting plant. More particularly, the present invention is directed to a clamping roll assembly in which a plurality of upper rolls are carried on a rotatably supported shaft. Most specifically, the present invention is directed to the mounting of the upper rolls on an eccentric shaft whereby the rollers can move vertically with respect to each other to compensate for varying thicknesses of the cast strands.

The withdrawal device of the present invention includes a lower roll which is driven, and at least a pair of upper rolls which are rotatably mounted on a common, rotatably supported, elongated, eccentric shaft. The shaft and its carried rollers can be raised and lowered as a unit since the ends of the shaft are connected to, for example, the rods of hydraulic cylinders. Since the shaft itself is eccentric, with the rolls being carried on the several eccentric portions, the roll can apply constant and uniform pressure to the several strands being withdrawn from the continuous casting plant even though the thicknesses of the strips vary from each other. The assembly can be modified to accept either greater or lesser differences in strand thicknesses by using shafts of greater or lesser eccentricity.

DESCRIPTION OF THE PRIOR ART

The use of upper and lower rolls in strand withdrawal devices for continuous casting plants is known generally in the art. In accordance with one known withdrawal device, each upper roller is pushed towards its corresponding strand by a separate hydraulic ram. However, because of the heat radiated by the withdrawn strand, the hydraulic cylinder or cylinders actuating each ram have been adversely affected. In addition, the provision of a separate ram for each upper roller has resulted in a more elaborate, costly, and less dependable machine.

A further difficulty with prior devices is one of applying uniform pressure to all the strands being withdrawn. It is often the case that the thickness of the strands varies during the casting and that the pressure applied thereto is accordingly not uniform. If the pressure is not uniform, the strands will be withdrawn incorrectly. Only a slight deviation in strip thickness due to tolerance deviations of the mould is sufficient to prevent proper clamping of the strip.

One proposed solution has been to straddle mount at least one of the upper or pinch rolls. The amount of straddling would, however, have to be accurately adjusted to the various tolerances of the corresponding strip and would require periodic readjustment which results in extended periods of lost time either before or during operation while the machine is down for this periodic readjustment.

SUMMARY OF THE INVENTION

It is an object of the present invention to provide a device for the withdrawal of at least two strands emerging parallel to each other from a mould of a continous casting plant wherein the pinch rollers automatically compensate for deviating thicknesses of the strands.

A further object of the present invention is to provide a strand withdrawal device including means to support the pinch rollers so as to eliminate the effect of heat radiated from the strands and to simplify construction.

In accordance with the present invention, the shaft which carries at least two upper or pinch rolls is provided with an eccentric portion so that the center lines of the rolls are eccentrically mounted to each other and to the center line of the shaft by 180°. Both of the pinch rolls adjust automatically to variations in strand thickness since the eccentric shaft is rotatably supported at its ends. Since the variation in thickness which can be accommodated is directly variable with the amount of offset between the two shaft portions, the amount of thickness deviation that can be handled by the assembly can be varied by using shafts of differing eccentricities.

When, for example, two strands of deviating thicknesses have arrived between the lower and upper rollers, the upper rollers are lowered, by their supporting hydraulic cylinders, toward the strips. One of the upper rollers will first contact one of the strips and the continued downward movement of the cylinders will rotate the shaft until the eccentricity of the shaft allows the upper roller which did not make the initial contact with the first strip to make contact with the second strand. So long as the thickness variation of the strands stay within the limits of the eccentricity of the shaft, the pressure applied to the strands will remain generally the same.

When the two strands are of equal thickness, the plane of the eccentric shaft is parallel to the direction of strand travel. As the amount of thickness variation increases, the plane of the eccentric shaft begins to change from the plane of travel of the strands until it is perpendicular thereto. In this position, the maximum thickness deviation between the two strands can be accommodated and uniform strand pressure applied.

BRIEF DESCRIPTION OF THE DRAWINGS

While the novel features of the present invention are set forth with particularity in the appended claims, a more full and complete explanation of the invention may be had by referring to the detailed description of the preferred embodiment and as set forth in the accompanying drawings in which:

DESCRIPTION OF A PREFERRED EMBODIMENT

Figure 1:
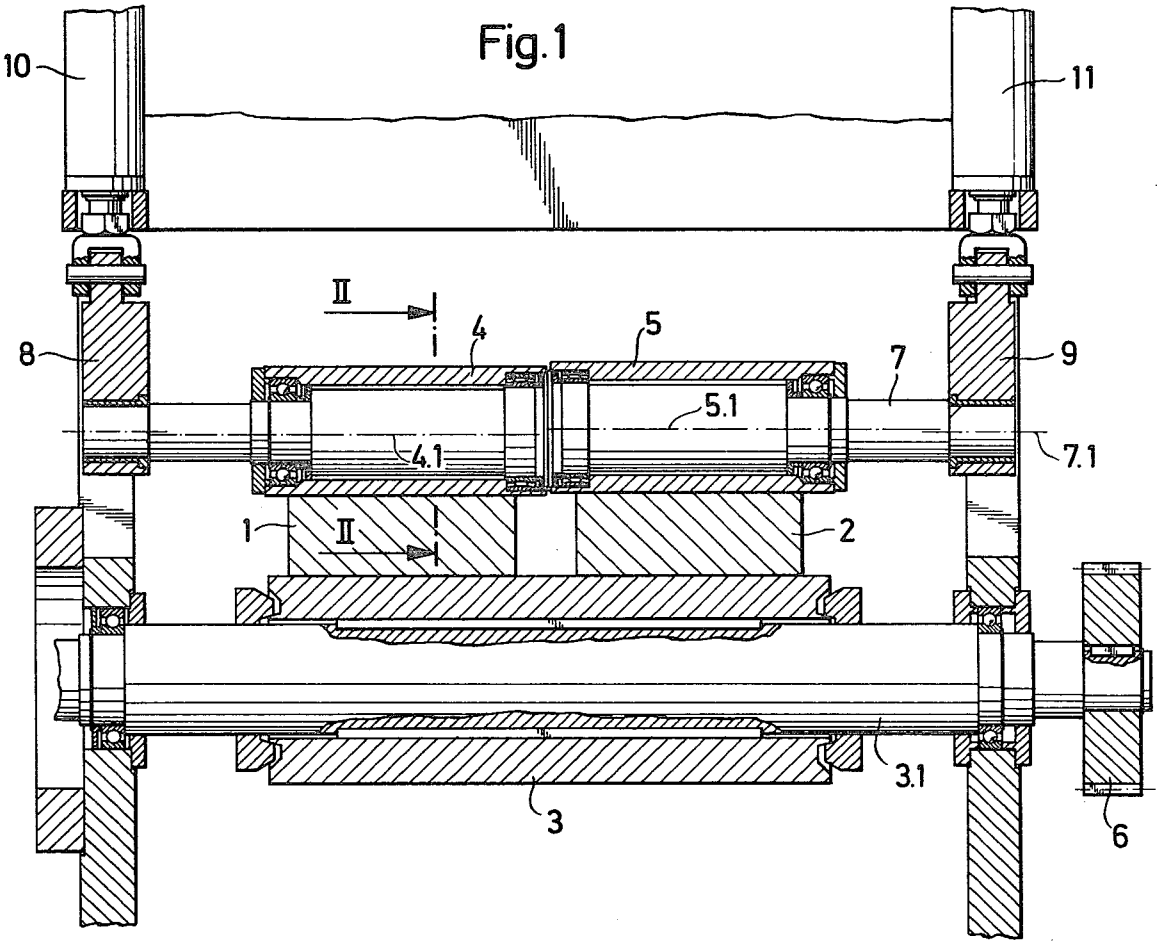
FIG. 1 is a front elevation view, partly in cross section of a strand withdrawal device in accordance with the present invention and showing the upper and lower rollers.

Turning to FIG. 1, there may be seen a preferred embodiment of a strand withdrawal assembly for use with a continuous casting plant. As may be seen, two strips 1 and 2 emerge from a mould (not shown) in a continous casting plant and enter between a lower roller 3 and at least two upper rollers 4 and 5. It will be understood that the number of upper rollers will equal the number of strands being withdrawn. Lower roller 3 is carried on an axle 3.1 which is, in turn, supported by suitable bearings in the base frame of the withdrawal unit. A gear 6 is secured to an outboard portion of axle 3.1 and drives lower roller 3 through a suitable gear reducer and drive unit (not shown). Any suitable drive means can be utilized to drive lower roller 3, and gear 6 is intended to be exemplary thereof.

Figure 2:
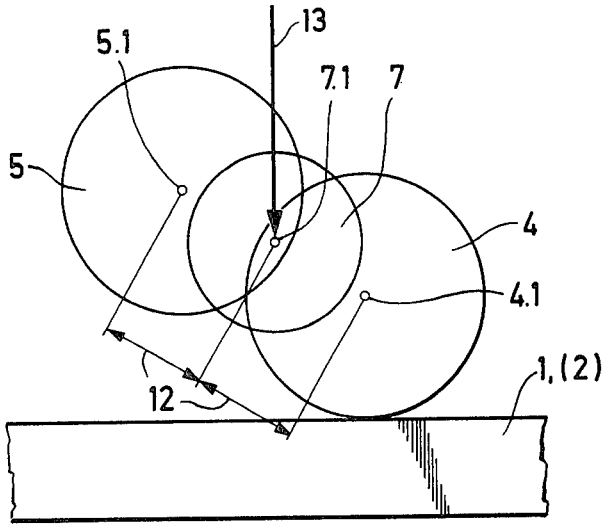
FIG. 2 is a schematic side elevational view taken along line II—II of FIG. 1 and showing schematically the eccentricty of the shaft.

Upper rollers 4 and 5 are rotatably carried on an eccentric axle or shaft 7 by suitable bearings or the like. It will be understood that each of the rollers 4 and 5 is free to rotate about shaft 7 independently of the other roller. Shaft 7 is, in turn, mounted for rotation in bearing blocks 8 and 9 which may be moved generally vertically by hydraulic cylinders 10 and 11. Shaft 7 is eccentric and has two upper roller support portions so that the upper rollers 4 and 5 are eccentrically arranged with reference to the center line 7.1 of shaft 7. As may be seen more clearly in FIG. 2, the center line 5.1 of roller 5 and the center line 4.1 of roller 4 are located at 180° to each other and are on opposite sides of the center line 7.1 of shaft 7. This amount of eccentricity of each of the rollers with regard to the shaft is indicated at 12.

In operation of the strand withdrawal assembly in accordance with the present invention, the cylinders 10 and 11 are actuated to lower rollers 4 and 5 toward the strands. As may be seen in FIG. 1, strand 2 is shown as having a greater thickness than strand 1. The upper roller 4 contacts strand 1 as the hydraulic cylinders continue to lower. Since strand 2 is thicker than strand 1 the downward force on shaft 7, as indicated by arrow 13 in FIG. 2, causes the shaft to rotate in a counterclockwise direction as viewed in FIG. 2 to bring upper roller 5 into engagement with strand 2. The hydraulic forces exerted by cylinders 10 and 11 are exerted equally on strands 1 and 2 since the shaft 7 has moved to a position in which rollers 4 and 5 contact strands 1 and 2 respectively with equal force. Both strands 1 and 2 are forced equally into contact with lower driven roller 3 and can be withdrawn from the mould equally and without slippage.

It will be understood that the present assembly will operate equally well regardless of which of the strands is thicker. The eccentric shaft 7 will rotate in its bearing blocks 8 and 9 as required to equalize the pressure on both strands regardless of which is the thicker. It will also be understood that a shaft with a greater degree of eccentricity could be substituted for shaft 7 should the thickness variation between the two strands exceed the eccentricity of shaft 7.

While there has hereinabove been fully and completely described a preferred embodiment of a strand withdrawal assembly for a continuous casting plant in accordance with the present invention, it will be obvious to one of ordinary skill in the art that a number of changes in, for example, the drive for the lower roller, the types of bearings used, spacing of the upper rollers, the positioning of the hydraulic cylinders and the like could be made without departing from the true spirit and scope of the invention and that the invention is to be limited only by the appended claims.

We claim:

1. A strand withdrawl assembly for withdrawal of strands emerging from a casting mould in a continuous casting plant, said strand withdrawal assembly comprising:

a lower roller, said lower roller being rotatably carried in said assembly and having drive means to rotate said lower roller;

at least first and second upper rollers, said upper rollers being each rotatably carried above said lower roller on a common eccentric shaft;

means rotatably supporting end portions of said eccentric shaft; and means raising and lowering said eccentric shaft to move said upper rollers into contact with the strands positioned between said upper and lower rollers for withdrawal whereby said eccentric shaft rotates in said support means to position said upper rollers to apply equal pressure to the strands positioned between said upper and lower rollers for uniform withdrawal of said strands.

2. The strand withdrawal assembly of claim 1 wherein said eccentric shaft includes two upper roller support portions eccentrically spaced at substantially 180° to each other.

3. The strand withdrawal assembly of claim 1 wherein said means raising and lowering said eccentric shaft includes a pair of spaced hydraulic cylinders, said cylinders supporting said end portions of said eccentric shaft.

* * * * *